US005765699A

United States Patent [19]

Griffin

[11] Patent Number: 5,765,699

[45] Date of Patent: Jun. 16, 1998

[54] APPARATUS FOR HOLDING AND STORING SWIMMING POOL MAINTENANCE EQUIPMENT

[76] Inventor: Mark W. Griffin, 6116 61st Dr. East, Palmetto, Fla. 34221

[21] Appl. No.: 709,840

[22] Filed: Sep. 10, 1996

[51] Int. Cl.[6] ..... A47F 5/00

[52] U.S. Cl. ..... 211/70.6; 211/87; 211/60.1; 211/89; 248/214; 248/206.3

[58] Field of Search ..... 211/94, 87, 70.6, 211/60.1, 65, 89, 85.7; 248/205.5, 206.3, 214, 316.8

[56] References Cited

U.S. PATENT DOCUMENTS

| | | | |
|---|---|---|---|
| 1,602,341 | 10/1926 | Day | 211/89 X |
| 1,848,937 | 3/1932 | Coventry | 211/87 X |
| 2,596,054 | 5/1952 | Tallman | 211/87 |
| 3,411,633 | 11/1968 | Magnuson | 211/87 X |
| 4,467,925 | 8/1984 | Ratzloff et al. | 211/70.6 |
| 5,137,158 | 8/1992 | Brockway | 211/87 |
| 5,386,915 | 2/1995 | Sirhan | 211/70.6 |
| 5,411,191 | 5/1995 | Bunn | 211/70.6 X |
| 5,626,244 | 5/1997 | Mesna et al. | 211/60.1 |

*Primary Examiner*—Robert W. Gibson, Jr.
*Attorney, Agent, or Firm*—Charles J. Prescott

[57] ABSTRACT

An apparatus for retaining and storing swimming pool maintenance equipment such as brushes, net scoops, tubular handles and extensions, bottom vacuum heads, flexible hoses and the like when not in use. The apparatus is releasibly connectable, preferably by spaced suction cups, to a top surface of a horizontal frame member of a swimming pool cage or screened enclosure, the frame member being elongated above the pool deck and typically having a rectangular tubular cross section of thin wall aluminum. A plurality of spaced brackets of various configurations are connected to the elongated support bar to which the suction cups are also connected, whereby the maintenance equipment is supported and stored. By attachment of the apparatus to a horizontal frame member of an out-of-the-way area of the pool cage, the maintenance equipment is readily accessible and will dry quickly when stored.

2 Claims, 4 Drawing Sheets

APPARATUS FOR HOLDING AND STORING SWIMMING POOL MAINTENANCE EQUIPMENT

BACKGROUND OF THE INVENTION

1. Scope of Invention

This invention relates generally to swimming pool maintenance equipment and implements, and more particularly to an apparatus for storing such items onto an apparatus which is attachable to a frame member of a screened swimming pool cage.

2. Prior Art

A wide variety of pieces of swimming pool maintenance equipment and implements are typically required to maintain the cleanliness and conditioning of swimming pools and water contained therein. Such items include deck brushes, pool wall scrubbers and vacuums, tubular handle extensions and flexible hose and nets for scooping debris from the surface and bottom areas of the pool.

After the equipment is used on a regular basis, drying and storage of such cleaning implements is typically at best an annoyance. Cabinets of the size sufficient to retain these cumbersome cleaning implements have to be quite large. Flexible hoses are sometimes hung from temporary wires attached to a ceiling area overhanging the pool or simply laid atop the pool deck without storage. When stored without being dried, mildew is likely.

Applicant is aware of a swimming pool equipment carrying case invented by Spooner as disclosed in U.S. Pat. No. 3,887,103. This carrying case, however, will typically accommodate only the smaller cleaning items such as brushes and small hand cleaning implements.

Killingsworth, in U.S. Pat. No. 253,638 describes a pool equipment cart which appears to be directed to carrying a chest or the like and is only remotely related to the present invention.

Many swimming pools are enclosed by a screened swimming pool cage which is structurally formed of box or rectangular section aluminum tubing. This application discloses an apparatus which will receive, retain and store virtually all of the implements associated with cleaning and maintaining a typical swimming pool and deck area associated with the screened swimming pool cage attached to home or building structures. The apparatus takes advantage of one of the horizontal frame members of the pool cage which is elevated above the deck area to about waist height. These frame members of the cage are typically tubular rectangular sections having a flat upper or top surface onto which the apparatus releasibly attaches preferably through suction cup means. By selecting a remote area of the pool cage and deck area, the maintenance implements may be easily stored and retrieved and conveniently dried after storage by being exposed to both sun and circulating air or breeze through the screened pool cage.

BRIEF SUMMARY OF THE INVENTION

This invention is directed to an apparatus for retaining and storing swimming pool maintenance equipment such as brushes, net scoops, tubular handles and extensions, bottom vacuum heads, flexible hoses and the like when not in use. The apparatus is preferably releasibly connectable, preferably by spaced suction cups, to a top surface of a horizontal frame member of a swimming pool cage or screened enclosure, the frame member being elongated above the pool deck and typically having a rectangular tubular cross section of thin wall aluminum. A plurality of spaced brackets of various configurations are connected along the length of the elongated support bar to which the suction cups are also connected, whereby the maintenance equipment is supported and stored. By attachment of the apparatus to a horizontal frame member of an out-of-the-way area of the pool cage, the maintenance equipment is readily accessible and will dry quickly when stored.

It is therefore an object of this invention to provide an apparatus which will conveniently store a broad range of swimming pool cleaning and maintenance implements in at out-of-the-way location around a caged swimming pool.

It is another object of this invention to provide a releasibly attachable apparatus for drying and storing implements for caged swimming pool maintenance without the need for installation or construction of additional cabinetry or swimming pool cage structure.

It is still another object of this invention to provide an apparatus for storing and drying swimming pool cleaning and maintenance implements, the apparatus itself receiving releasible attaching support from a horizontal frame member of a screened swimming pool cage.

In accordance with these and other objects which will become apparent hereinafter, the instant invention will now be described with reference to the accompanying drawings.

DETAILED DESCRIPTION OF THE INVENTION

Figure 7:
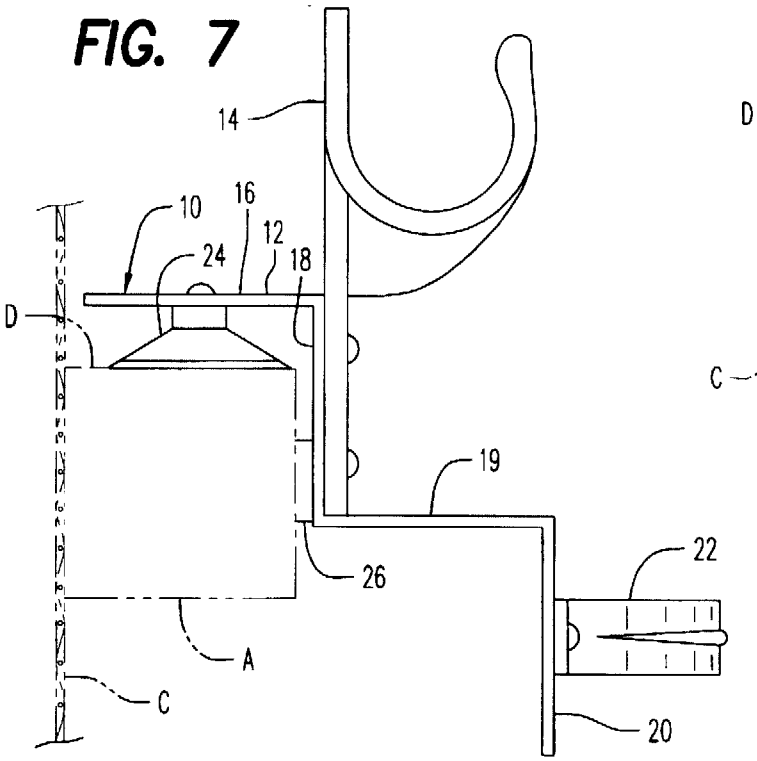
FIG. 7 is an end view in the direction of arrows 7—7 in FIG. 1.

Referring now to the drawings, and particularly to FIGS. 1, 3, 4 and 7, one embodiment of the invention is shown generally at numeral 10 and includes an elongated support bar 12 which is formed of a series of edgewise orthogonally oriented flat sections 16, 18, 19 and 20 of thin aluminum channel or angle bar stock. Having somewhat of a "W" shaped cross section, the support bar 12 has attached to an underside of its upper horizontal section 16 a plurality of spaced apart soft flexible molded plastic suction cups 24 as best seen in FIG. 7. These suction cups 24 are downwardly facing and sized and positioned with respect to an upright flat section 18 of support bar 12 for convenient engagement on a top surface D of a thin wall rectangular aluminum section frame member A of a screened pool cage (not shown in entirety). These horizontal frame members shown typically at A in the Figures, span between upright pool cage members B and are supportively positioned with respect to screen material shown typically at C.

As seen in FIG. 7, a plurality of spaced rubber pads 26 attached to one surface of the upright flat section 18 of support bar 12 contact against one upright surface of horizontal frame member A when each suction cup 24 is attached to surface D as shown.

Figure 4:
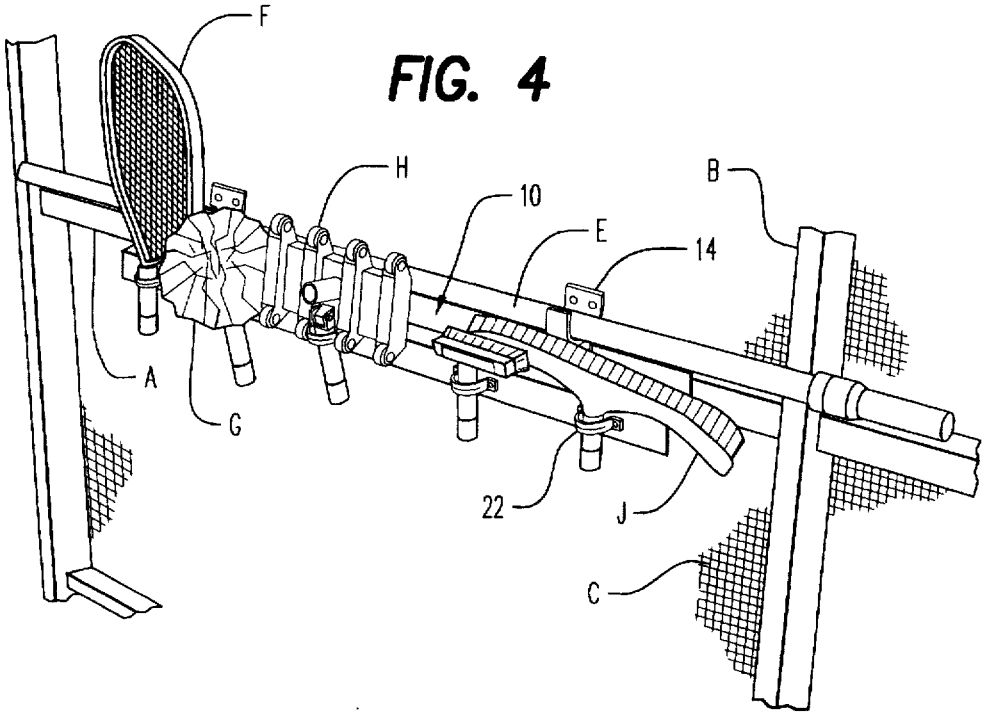
FIG. 4 is a perspective view of the embodiment of FIG. 1 in use.

Permanently attached by fasteners to the support bar 12 are a plurality of molded plastic brackets 14 and 22 which are positioned and adapted to support a broad variety of implements as shown in FIG. 4 used for cleaning and maintaining the swimming pool and deck area. Spaced brackets 14 supportively receive a cleaning handle E or other straight elongated implement, while looped brackets 22 supportively receive the handle or tubular attaching extension portions of such implements as a net F, a scrubber G, a vacuum head H, and brushes J in their upright orientation. Note importantly that these swimming pool cleaning implements, when stored as in FIG. 4, are exposed to sunlight and breeze so that in the stored position, they will thoroughly dry without developing mildew or remaining wet or damp in any fashion.

Note also that the apparatus 10 may easily be removable by releasing the attaching vacuum within these suction cups 24 and that installation is accomplished without the need for any tools or disfigurement or alteration of any portion of the swimming pool cage frame members A or B.

Figure 1:
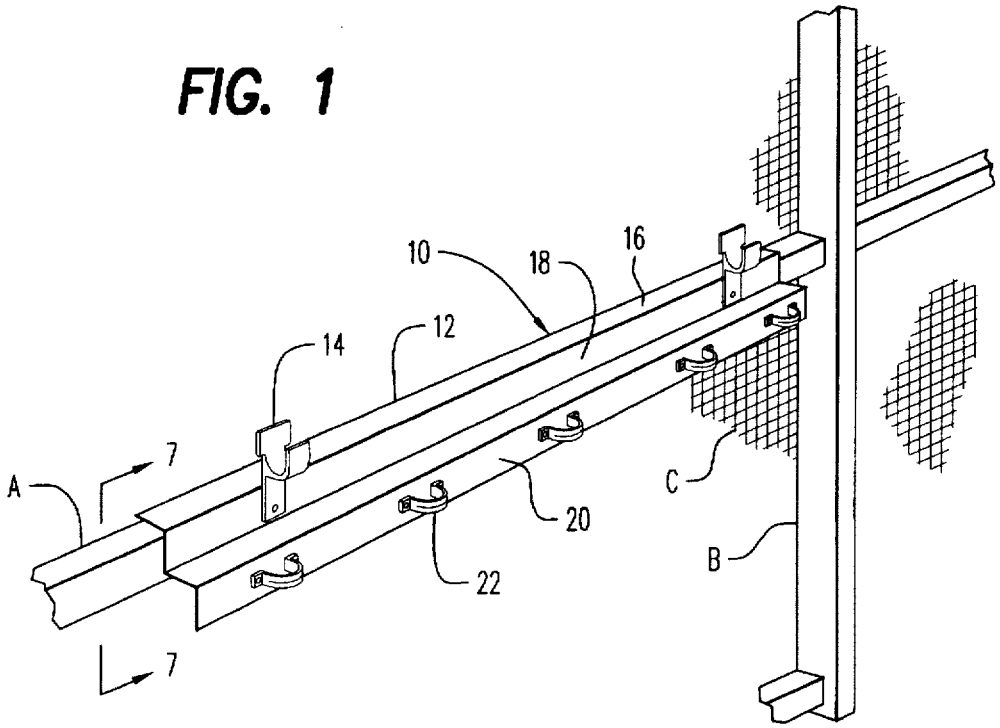
FIG. 1 is a perspective view of one embodiment of the invention attached to a horizontal frame member of screened swimming pool cage.
Figure 2:
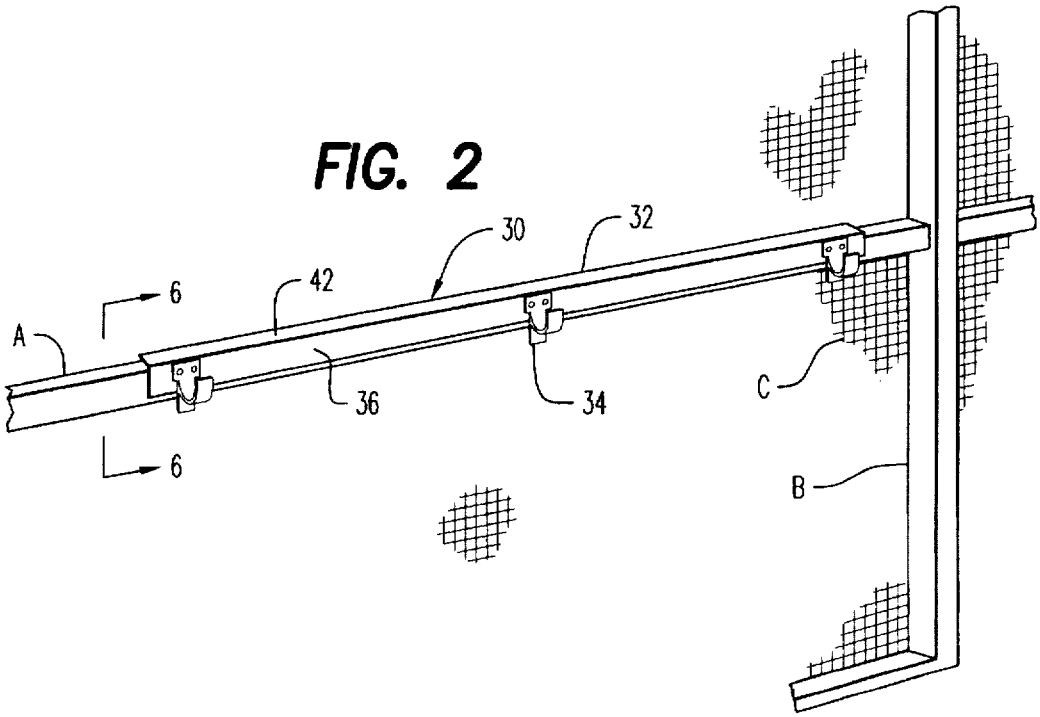
FIG. 2 is a perspective view of another embodiment of the invention attached to a horizontal frame member of a screened swimming pool cage.
Figure 3:
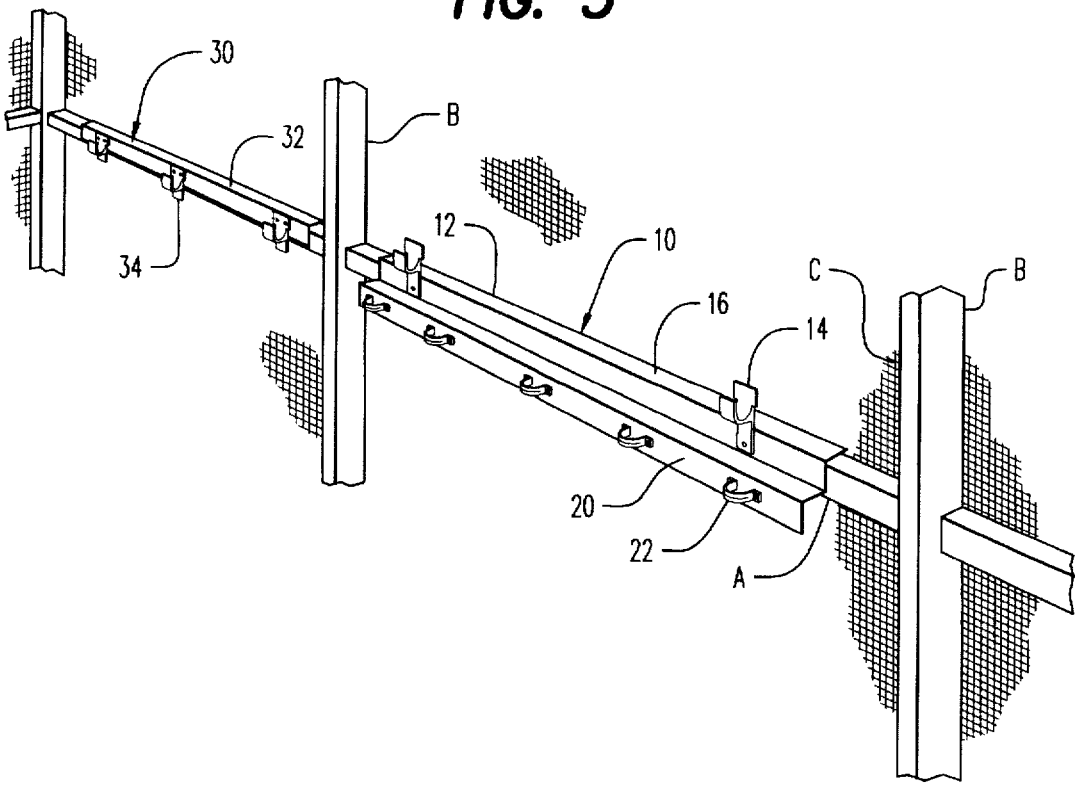
FIG. 3 is a perspective view of embodiments of FIGS. 1 and 2 attached to separate adjacent horizontal frame members of the screened swimming pool cage.
Figure 5:
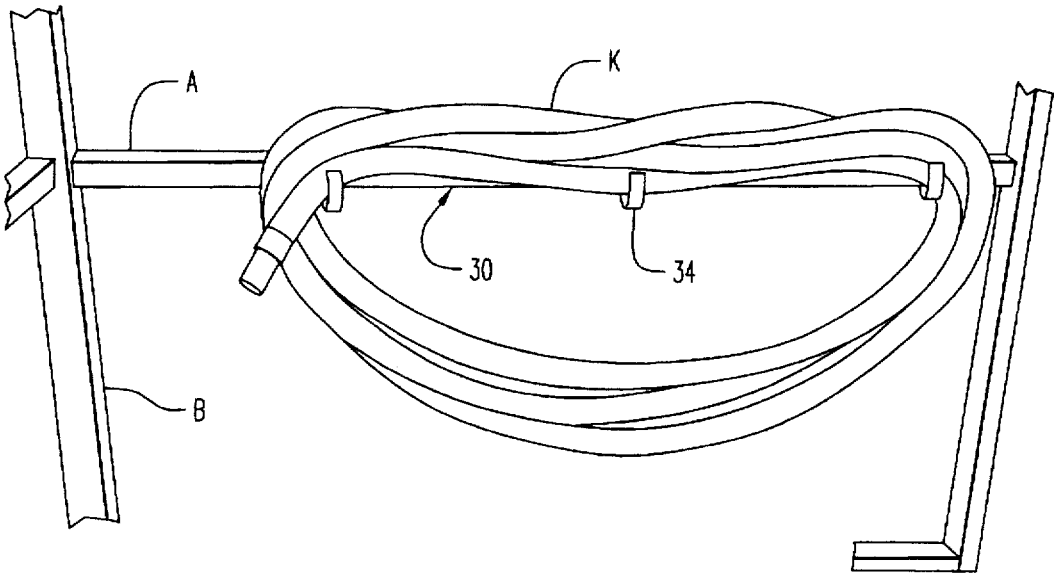
FIG. 5 is a perspective view of the embodiment of FIG. 2 in use.
Figure 6:
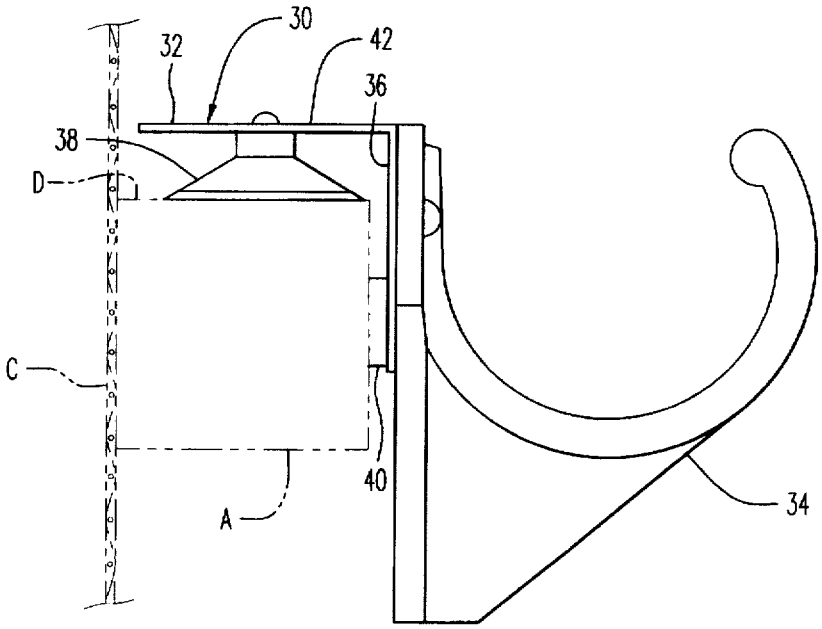
FIG. 6 is a view in the direction of arrows 6—6 in FIG. 2.

Referring now to FIGS. 2, 5 and 6, another embodiment of the invention is shown generally at numeral 30 which also includes an elongated support bar 32 which is generally L-shaped in cross section and formed of a thin wall aluminum channel angle iron. This embodiment 30 also includes a plurality of suction cups 38 which are disposed on the lower surface of the upper horizontal portion 42 of the support bar 32 as seen in FIG. 6.

When attached to the horizontal frame member A by suction cups 38, a rubber spacer 40 prevents the upright leg or support bar portion 36 from connecting against the frame member A and provides additional anti-friction support against movement of the apparatus 30 as cleaning and maintenance implements are stored and removed.

This embodiment 10 includes a plurality of spaced U-shaped brackets 34 which open upwardly and are sized and positioned so as to support and store an elongated flexible hose K which is associated with the cleaning implements of all swimming pools. Typically, this flexible hose is attached at one end to a swimming pool pump inlet which draws water from the swimming pool into a filtration unit. The other end of the flexible hose K is then attached to such implements as a vacuum head H shown in FIG. 4, sometimes utilized in conjunction with an intermediate elongated extension tube therebetween.

Again, with respect to this embodiment 30, no alteration of the horizontal frame member A or upright frame member B of the swimming pool cage is required and the apparatus 30 may be easily attached and removed as desired by appropriate manipulation of the spaced suction cups 38.

Figure 8:
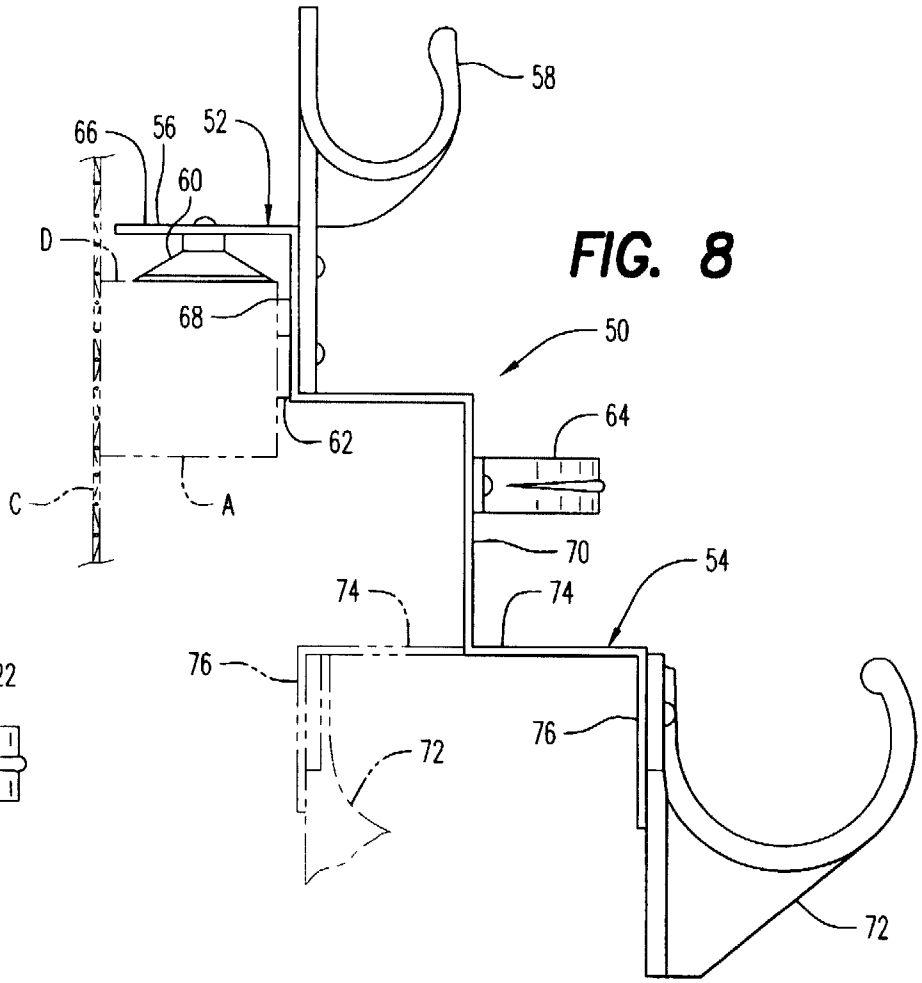
FIG. 8 is an end view similar to that of FIGS. 6 and 7 of yet another embodiment of the invention which combines the features of both FIG. 6 and FIG. 7.

Referring now to FIG. 8, another embodiment of the invention is there shown at numeral 50 and represents a combination of the embodiments 10 and 30. This embodiment 50 includes an elongated thin-walled aluminum support bar 52 having a plurality of flat sections 56, 62, 70, 74 and 76 which are oriented and coextensive one to another in a generally sawtooth cross section arrangement shown. The plurality of spaced suction cups 60 are downwardly disposed from the lower or under surface of flat section 66 in relation to a plurality of spaced rubber spacers 62 attached to flat upright section 68 which is orthogonally oriented to flat section 66 as shown. By the interaction between suction cups 60 and rubber spacers 62, the apparatus 10 is attachable to the horizontal frame member A of the swimming pool cage without alteration to any frame member A whatsoever.

Spaced brackets 58 are similar to brackets 14 of embodiment 10 and are adapted to support elongated tubular members such as handle E in FIG. 4. Brackets 64 are similar to brackets 22 of embodiment 10 and are connected in spaced fashion along flat section 70 for supporting the various handles and connecting tubular extensions of the remainder of the cleaning implements shown in FIG. 4. Bracket 72 is similar to bracket 34 in embodiment 10 and a plurality of these brackets 72 are connected in spaced fashion along flat section 76 for supporting the flexible hose K as in FIG. 5.

Should the weight of the flexible hose K resting upon spaced bracket 72 place too much of a strain upon the releasible attaching suction cup means 60, flat section 74 may extend in the opposite direction (shown in phantom) from upright flat section 70 so that brackets 72 will then generally be positioned directly below brackets 58.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. An apparatus used in conjunction with a caged swimming pool for holding and storing swimming pool maintenance equipment, said apparatus comprising:

a plurality of bracket means each for retaining and supporting a piece of swimming pool maintenance equipment;

an elongated support bar for rigidly holding each said bracket means in dependent spaced relation along a length of said support bar, said support bar defining a downwardly facing substantially flat horizontal surface;

attaching means connected to, and downwardly facing from, said horizontal surface for releasibly attaching and supporting said support bar means above a deck surface of the swimming pool to an elongated horizontal pool cage frame member whereby the swimming pool maintenance equipment may be supported and stored in one or more of said plurality of bracket means;

said attaching means including a plurality of spaced apart suction cups positioned on said horizontal surface for engagement along a top horizontal surface of the pool cage member.

2. An apparatus supportively engageable on a swimming pool cage horizontal frame member of a swimming pool, said apparatus for holding and storing pieces of swimming pool maintenance equipment, said apparatus comprising:

an elongated support bar formed of thin, flat sections including an L-shaped cross section defined by an upper horizontal flat section and an upright flat section downwardly disposed from said upper horizontal flat section;

attaching means connected and downwardly facing from a lower surface of said upper horizontal flat section for releasable engagement with, and support from, a top surface of the horizontal frame member;

a plurality of spaced brackets each connected to said support bar adapted in shape and position for retaining and supporting the swimming pool maintenance equipment;

said attaching means including a plurality of spaced apart suction cups positioned on said support bar means for engagement along a top horizontal surface of the pool cage member.

* * * * *